US008928296B2

(12) United States Patent
Iriarte et al.

(10) Patent No.: US 8,928,296 B2
(45) Date of Patent: Jan. 6, 2015

(54) HIGH POWER SUPPLY REJECTION RATIO (PSRR) AND LOW DROPOUT REGULATOR

(75) Inventors: Santiago Iriarte, Valencia (ES); Alberto Marinas, El Puig (ES)

(73) Assignee: Analog Devices, Inc., Norwood, MA (US)

( * ) Notice: Subject to any disclaimer, the term of this patent is extended or adjusted under 35 U.S.C. 154(b) by 700 days.

(21) Appl. No.: 13/112,335

(22) Filed: May 20, 2011

(65) Prior Publication Data

US 2012/0223688 A1 Sep. 6, 2012

Related U.S. Application Data

(60) Provisional application No. 61/448,060, filed on Mar. 1, 2011.

(51) Int. Cl.

| | |
|---|---|
| ***G05F 1/00*** | (2006.01) |
| ***G05F 3/26*** | (2006.01) |
| ***G05F 1/56*** | (2006.01) |

(52) U.S. Cl.

CPC . *G05F 1/56* (2013.01); *G05F 3/262* (2013.01)
USPC ..... 323/280

(58) Field of Classification Search

CPC ..... G05F 1/56; G05F 3/262
USPC ..... 323/273, 275, 280, 281; 327/538, 540, 327/541, 543
See application file for complete search history.

(56) References Cited

U.S. PATENT DOCUMENTS

| | | | | |
|---|---|---|---|---|
| 6,633,198 | B2 * | 10/2003 | Spalding, Jr. | 327/538 |
| 6,861,832 | B2 * | 3/2005 | Perez | 323/316 |
| 8,089,261 | B2 * | 1/2012 | Lipka | 323/315 |
| 8,305,066 | B2 * | 11/2012 | Lin et al. | 323/285 |
| 2004/0140845 | A1 * | 7/2004 | Eberlein | 327/541 |
| 2011/0181259 | A1 * | 7/2011 | Shen | 323/282 |

* cited by examiner

*Primary Examiner* — Matthew Nguyen
(74) *Attorney, Agent, or Firm* — Kenyon & Kenyon, LLP

(57) ABSTRACT

A low dropout voltage regulator (LDO) includes first and second amplifiers and a current mirror. The first amplifier includes a first input receiving a reference voltage and a second input receiving a voltage proportional to an output of the LDO. The current mirror includes an input current at a first end of the current mirror to an output current at a second end of the current mirror, the input current controlled by an output of the first amplifier and the output current being supplied to the output of the LDO. The second amplifier includes a first input coupled to the first end of the current mirror and a second input coupled to the second end of the current mirror.

20 Claims, 9 Drawing Sheets

HIGH POWER SUPPLY REJECTION RATIO (PSRR) AND LOW DROPOUT REGULATOR

CROSS-REFERENCE TO RELATED APPLICATIONS

This application claims priority from U.S. Provisional Patent Application No. 61/448,060, filed on Mar. 1, 2011, which is incorporated herein in its entirety.

FIELD OF THE INVENTION

The present invention is generally directed to low dropout voltage regulators (LDOs). In particular, the present invention is directed to LDOs that maintain high power supply rejection ratio (PSRR) under very low voltage drop conditions.

BACKGROUND INFORMATION

Low dropout voltage regulators (LDOs) are voltage regulators that may operate with a small input-output differential voltage while maintaining a substantially constant output voltage. One performance measure of LDOs is power supply rejection ratio (PSRR) which measures how well an LDO rejects noise contained in the input voltage. Higher PSRR means that the output voltage is less sensitive to the noise component contained in the input voltage and is thus more desirable.

FIG. 1 illustrates an LDO that is commonly known in the art. The LDO as shown in FIG. 1 includes an amplifier 12, a PMOS 14, resistors 16, 18, and a capacitor 10 for load compensation. The amplifier 12 includes a first input coupled to a reference voltage $V_{REF}$ and a second input for receiving a feedback voltage $V_{FB}$. An output of the amplifier 12 is coupled to a gate of the PMOS 14. A source of the PMOS 14 is coupled to a voltage source $V_{DD}$, and a drain of the PMOS 14 is coupled to the serially-connected resistors 16, 18. The serially-connected resistors 16, 18 form a voltage divider which provides the feedback voltage $V_{FB}$ to the second input of the amplifier 12. The drain of PMOS 14 provides an output voltage $V_{OUT}$ to capacitor 10. The output voltage $V_{OUT}$ may be divided by the voltage divider formed by resistors 16, 18 to produce the feedback voltage $V_{FB}$ proportional to $V_{OUT}$, where the proportional ratio is determined by the resistance values of resistors 16, 18. The amplifier 12 minimizes the voltage difference between $V_{REF}$ and $V_{FB}$ so that voltage fluctuations in $V_{OUT}$ caused by noise in $V_{DD}$ may be mitigated through the feedback loop and $V_{OUT}$ may be kept substantially free of the noise component in $V_{DD}$. However, the LDO as shown in FIG. 1 may have certain drawbacks. For example, the high frequency component in the input may be passed to the output of the LDO directly because of the limited bandwidth of the LDO. When the feedback loop is open, the noise component in $V_{DD}$ may be directly passed to $V_{OUT}$, and thus PSRR suffers. When $V_{DD}$ is much higher than $V_{OUT}$ ($V_{DD} >> V_{OUT}$), the output PMOS works in the saturation mode, and PSRR is usually very high in low-to-mid frequency range (F<Gain Bandwidth (GBW)) due to the gain of the LDO. However, when the voltage dropout is low (VDD−VOUT≤100 mV) and the output current $I_{OUT}$ is high or at maximum, the PSRR is usually low because the output transistor 14 may be transitioned from a saturation mode to a triode mode due to the low differential voltage from $V_{DD}$ to $V_{OUT}$. This transition from the saturation mode to the triode mode may cause cause LDO gain loss and worsen PSRR at output.

FIG. 2 illustrates another LDO that is known in the art. The LDO as shown in FIG. 2 includes an NMOS 15 and gate-to-gate connected PMOS 20, 22 that form a current mirror. The sources of PMOS 20, 22 are coupled to the input voltage $V_{DD}$. Thus, the current that flows through the output PMOS 22 may mirror the current that flows through the mirror PMOS 20. However, when the voltage drop is low (or $V_{DD}-V_{OUT} \leq 100$ mV), the output PMOS 22 may be transitioned from a saturation mode to a triode mode while the mirror PMOS 20 is still in the saturation mode. This mode imbalance between the output PMOS 20 and mirror PMOS 22 for low dropout voltages may cause low PSRR. Further, another drawback of the circuit as shown in FIG. 2 is that the gate of the output PMOS 22 is not pulled down close to ground, which results in the need for a much larger PMOS 22 for a given voltage dropout. A large PMOS 22 occupies more circuit area and consumes more power.

FIG. 3 illustrates another LDO that is similar to the LDO as shown in FIG. 2. Compared to FIG. 2, the LDO as shown in FIG. 3 further includes gate-to-gate connected PMOS 24, 26, and a current source 28, all of which may allow the gate of the output PMOS 22 to be pulled close to ground. However, the LDO as shown in FIG. 3 still suffers the same drawback of imbalanced current mirror at low dropout as the LDO of FIG. 2. Further, the LDO as shown in FIG. 3 may be difficult to stabilize during a transition from the triode mode to the saturation mode.

DETAILED DESCRIPTION OF EXAMPLE EMBODIMENTS

Therefore, there is a need for LDOs that may maintain high PSRR even during very low voltage dropouts. Further, there is a need for LDOs that may maintain a balanced current mirror output during operation—i.e., the output PMOS and the mirror PMOS operate at the same saturation mode or the same triode mode even during very low voltage dropouts.

An exemplary embodiment of the present invention may include a low dropout voltage regulator (LDO) that may include a first amplifier including a first input receiving a reference voltage and a second input receiving a voltage proportional to an output of the LDO; a current mirror that mirrors an input current at a first end of the current mirror to an output current at a second end of the current mirror, the input current controlled by an output of the first amplifier and the output current being supplied to the output of the LDO; and a second amplifier including a first input coupled to the first end of the current mirror and a second input coupled to the second end of the current mirror.

Figure 1:
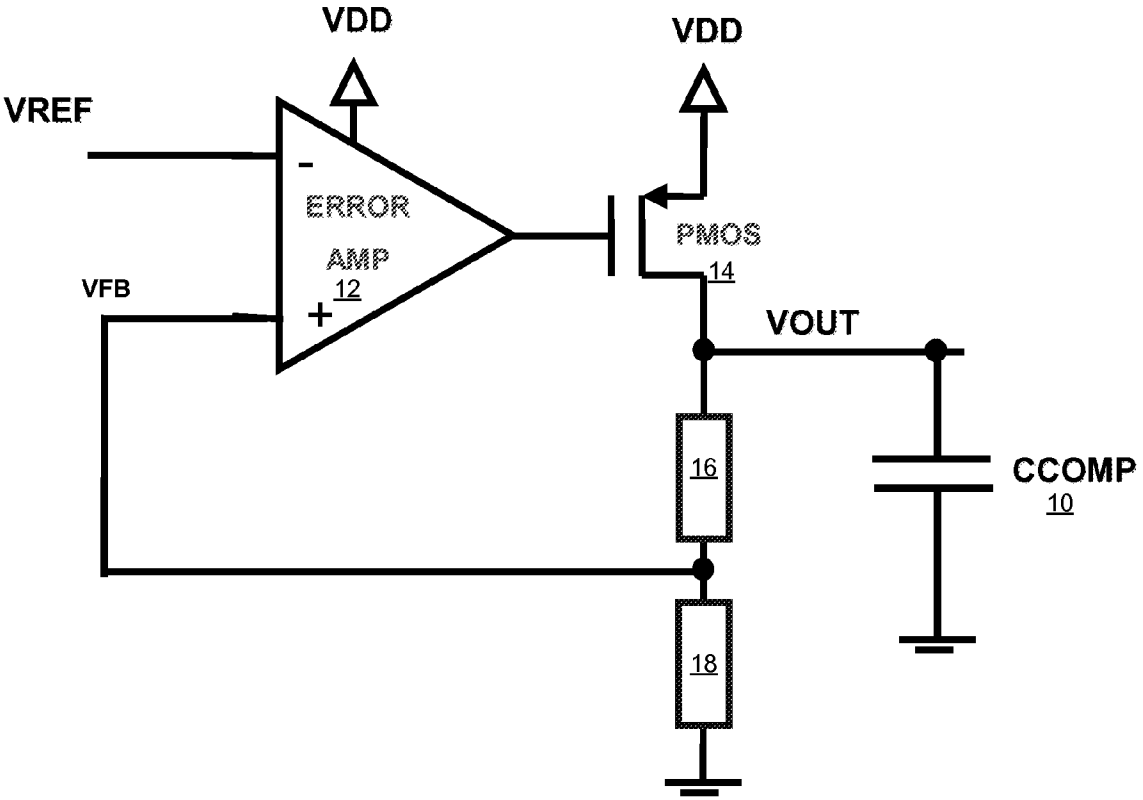
FIG. 1 (Prior Art)
FIG. 1 illustrates a standard LDO.
Figure 2:
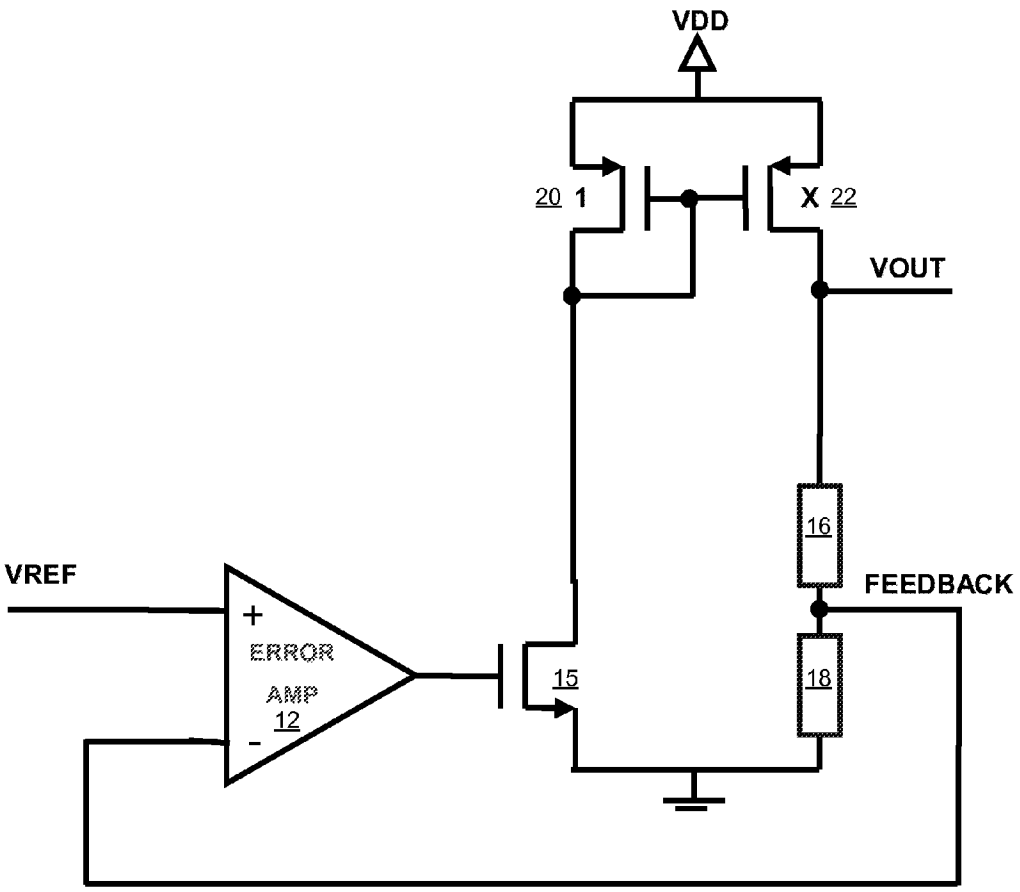
FIG. 2 (Prior Art)
FIG. 2 illustrates a standard LDO with a current mirror output.
Figure 3:
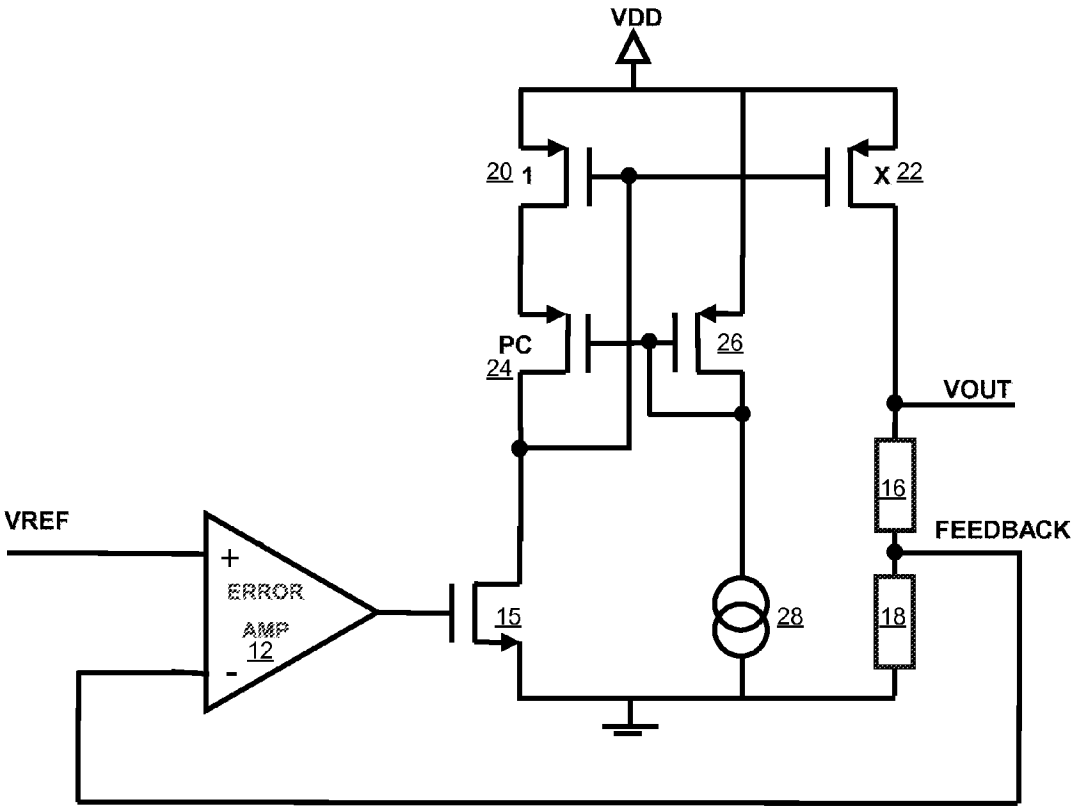
FIG. 3 (Prior Art)
FIG. 3 illustrates a variation of the standard LDO with a current mirror output.
Figure 4A:
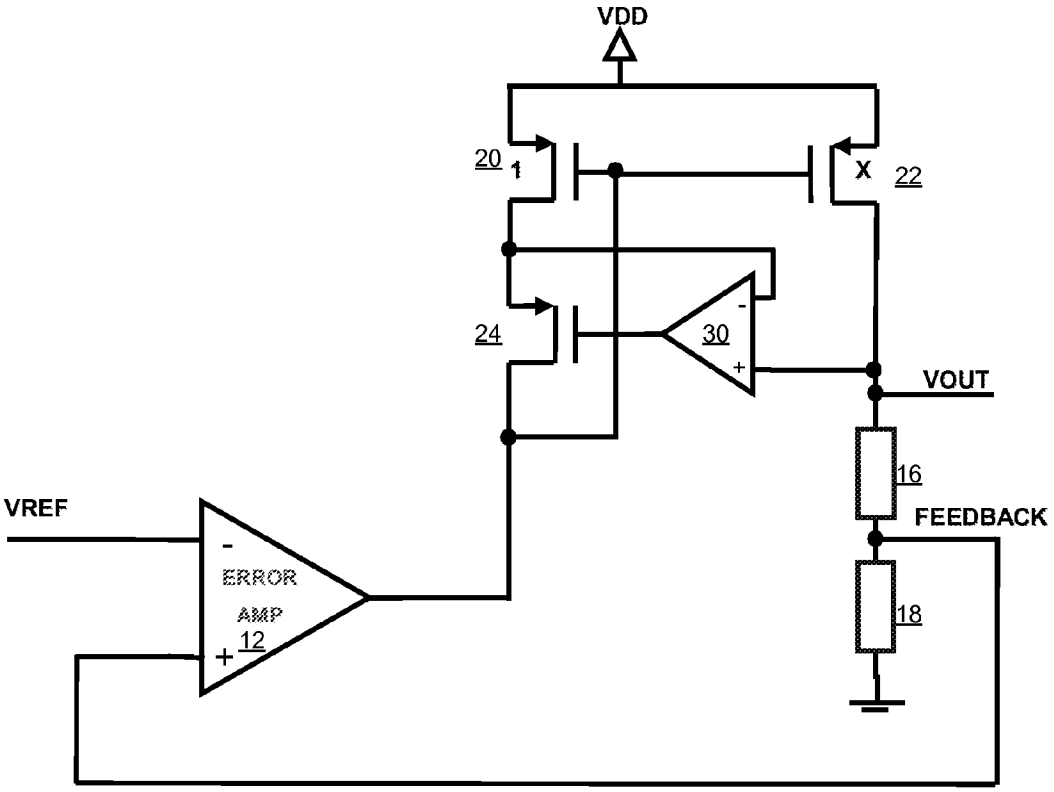
FIGS. 4A-4B illustrate an LDO according to an exemplary embodiment of the present invention.

FIG. 4A illustrates an LDO that may maintain a high PSRR in very low dropout scenarios according to an exemplary embodiment of the present invention. The LDO as shown in FIG. 4A may include an amplifier 12, a PMOS 24, an output voltage sampler formed by resistors 16, 18, and a current mirror including gate-to-gate connected PMOS 20, 22 similarly connected as shown in FIG. 3. The LDO as shown in FIG. 4A may further include another amplifier 30 having a first input (+) coupled to the output $V_{OUT}$ (or the drain of the output PMOS 22), a second input (−) coupled to the drain of the mirror PMOS 20, and an output of the amplifier 30 coupled to the gate PMOS 24. It should be noted that the serially-connected resistors 16, 18 are only an exemplary output voltage sampler. Other suitable voltage sampler known to an ordinary person skilled in the art that measures a voltage relating to the output voltage may be used to sample the output voltage.

In operation, amplifier 30 may minimize the voltage difference between the first and second inputs and drive the voltage at the drain of the mirror PMOS 20 to follow $V_{OUT}$ (or the drain of the output PMOS 22). Thus, when the dropout is low ($V_{DD}-V_{OUT}\leq 100$ mV) and the output PMOS 22 is transitioned into a triode mode, the source-to-drain voltage dropout over the mirror PMOS 20 is also low and the mirror PMOS 20 is also transitioned into the triode mode. In this way, the output PMOS 22 may work in the same mode as the mirror PMOS 20. Thus, the current mirror may work properly in balance even during very low voltage dropouts. Thus, the LDO of FIG. 4A may still maintain high PSRR even during very low dropouts.

Figure 4B:
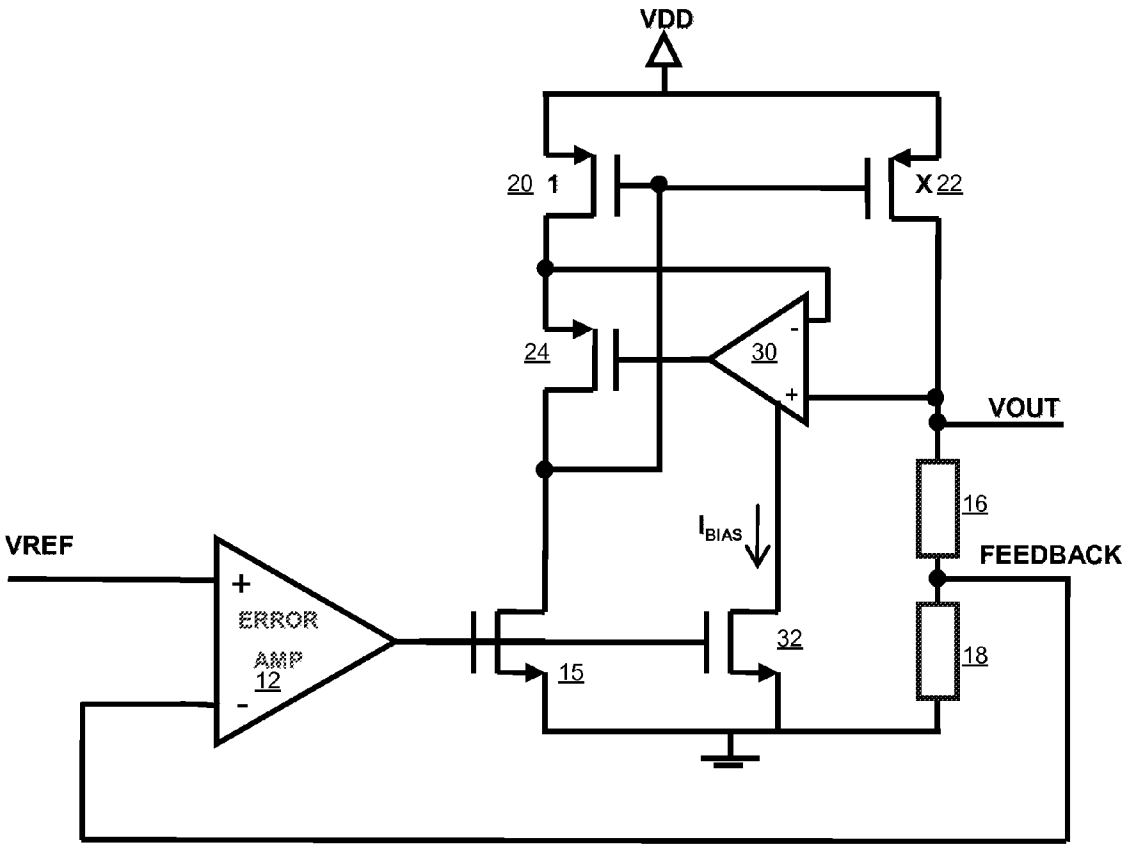

FIG. 4B illustrates an exemplary embodiment that is similar to the one as illustrated in FIG. 4A. Compared to FIG. 4A, the LDO of FIG. 4B further includes gate-to-gate connected NMOS 15, 32. The gates of NMOS 15, 32 may be coupled to the output of amplifier 12, and their sources may be coupled to the ground to form a current mirror. A drain of NMOS 15 may be coupled to the drain of PMOS 24, and a drain of NMOS 32 may be coupled to amplifier 30 to provide a bias current to the amplifier 30. Commonly, in the place of NMOS 32 may be a current source that is independent of the currents that flow through PMOS 20, 22 to provide the bias current. However, in the exemplary embodiment, NMOS 32 may be chosen to match NMOS 15 so that the bias current through NMOS 32 may be proportionally related to those flowing through PMOS 20, 22 and thus improve the stability of the LDO.

Figure 5:
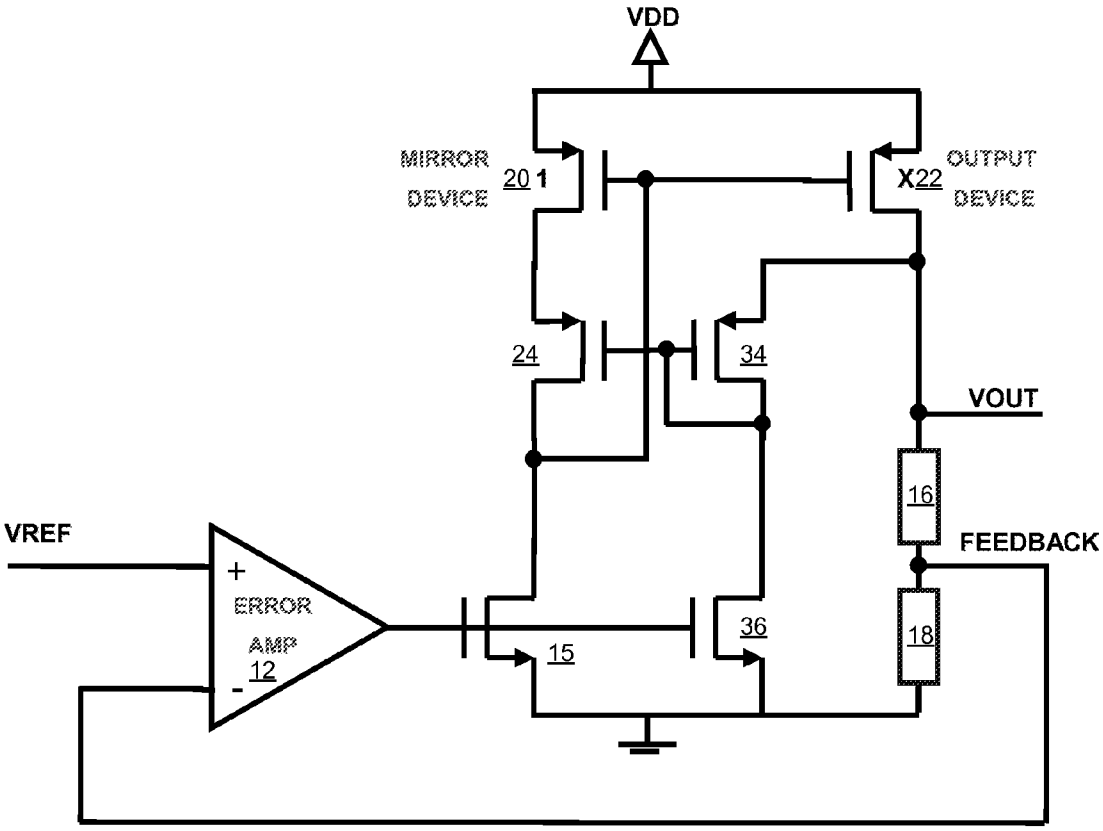
FIG. 5 illustrates another LDO according to an exemplary embodiment of the present invention.

FIG. 5 illustrates another LDO according to an exemplary embodiment of the present invention. The LDO as shown in FIG. 5 may include an amplifier 12, transistors of NMOS 15 and PMOS 24, a voltage sampler formed by resistors 16, 18, and a current mirror including gate-to-gate connected PMOS 20, 22 similarly connected as shown in FIG. 3. The LDO may further include cascaded transistors of PMOS 34 and NMOS 36. Transistors 15, 24, 34, 36 may form an amplifier circuit that may replace the amplifier 30 and transistor 24 of FIG. 4A. The source of PMOS 34 may be coupled to the drain of output PMOS 22, and the gate and drain of PMOS 34 may be coupled to the gate of PMOS 24. The gate of NMOS 36 may be coupled to the gate of NMOS 15. The PMOS 34 may be chosen to match PMOS 24, and NMOS 36 may be chosen to match NMOS 15 in order to achieve a low offset for the amplifier formed by transistors 15, 24, 34, 36. The amplifier formed by transistors 15, 24, 34, 36 may keep the drain voltages of PMOS 20, 24 at the same or substantially the same level. Thus, PMOS 20, 22 may operate in the same saturation mode or the same triode mode, and the LDO may have high PSRR.

Figure 6:
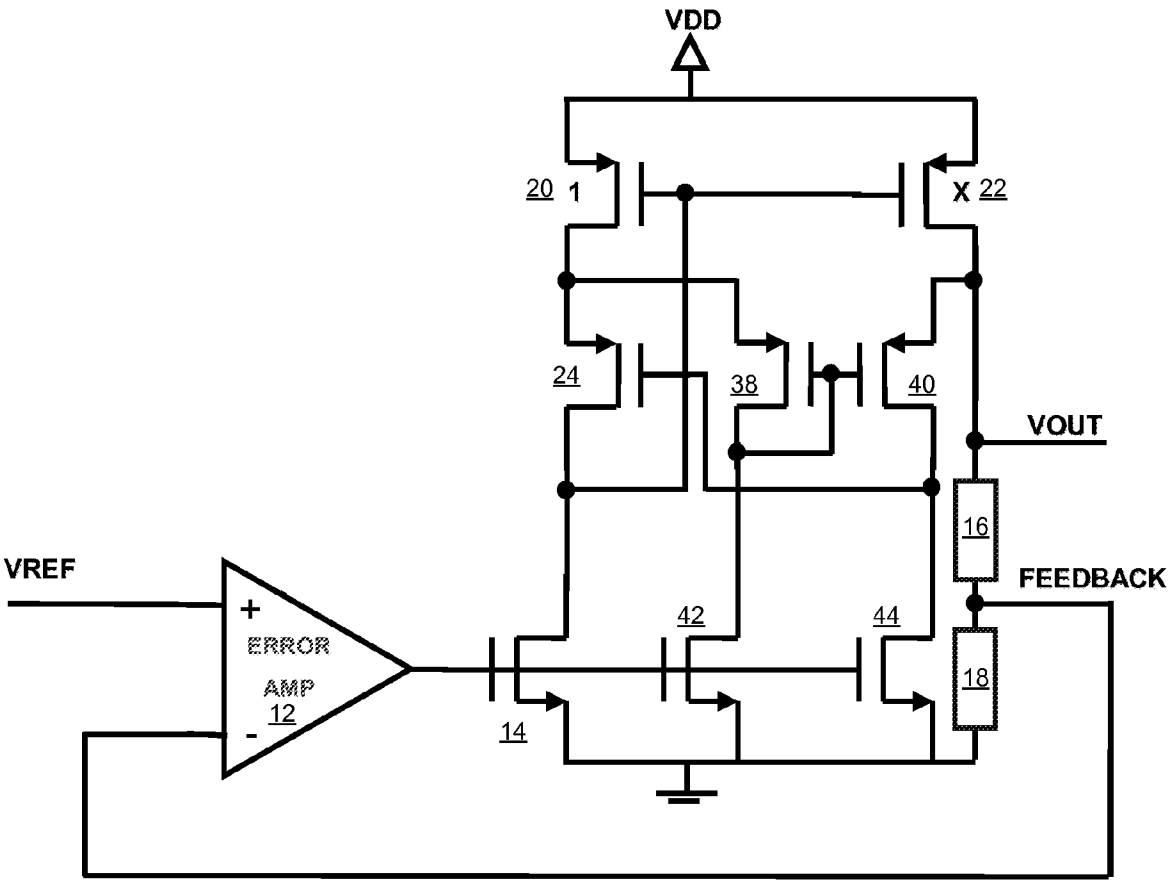
FIG. 6 illustrates another LDO according to an exemplary embodiment of the present invention.

FIG. 6 illustrates another LDO according to an exemplary embodiment of the present invention. In this embodiment, the voltage following circuit between $V_{OUT}$ and voltage at the drain of PMOS 20 may be formed by PMOS 38, 40, and NMOS 42, 44. PMOS 38, 40 are back-to-back coupled at their gates. Further, NMOS 42 may generate a bias current for PMOS 38, and NMOS 44 may generate a bias current for PMOS 40. The gate of PMOS 38 may be coupled to the drain of PMOS 38. Transistors 24, 28, 40, 15, 42, 44 may form another exemplary circuit for amplifier 30 and transistor 24 of FIG. 4A. PMOS 24, 38, 40 may be chosen to match each other, and NMOS 15, 42, 44 may be chosen to match each other in order to achieve a low offset in the formed amplifier. This amplifier may keep the drains of PMOS 20, 22 at the same or substantially the same level. Additionally, this exemplary embodiment of amplifier 30 may have higher amplifier gain and thus higher accuracy. Thus, the voltage at the drain of PMOS 20 may follow $V_{OUT}$, and PMOS 20, 22 may operate in the same saturation mode or the same triode mode, and the LDO may have high PSRR.

Figure 7:
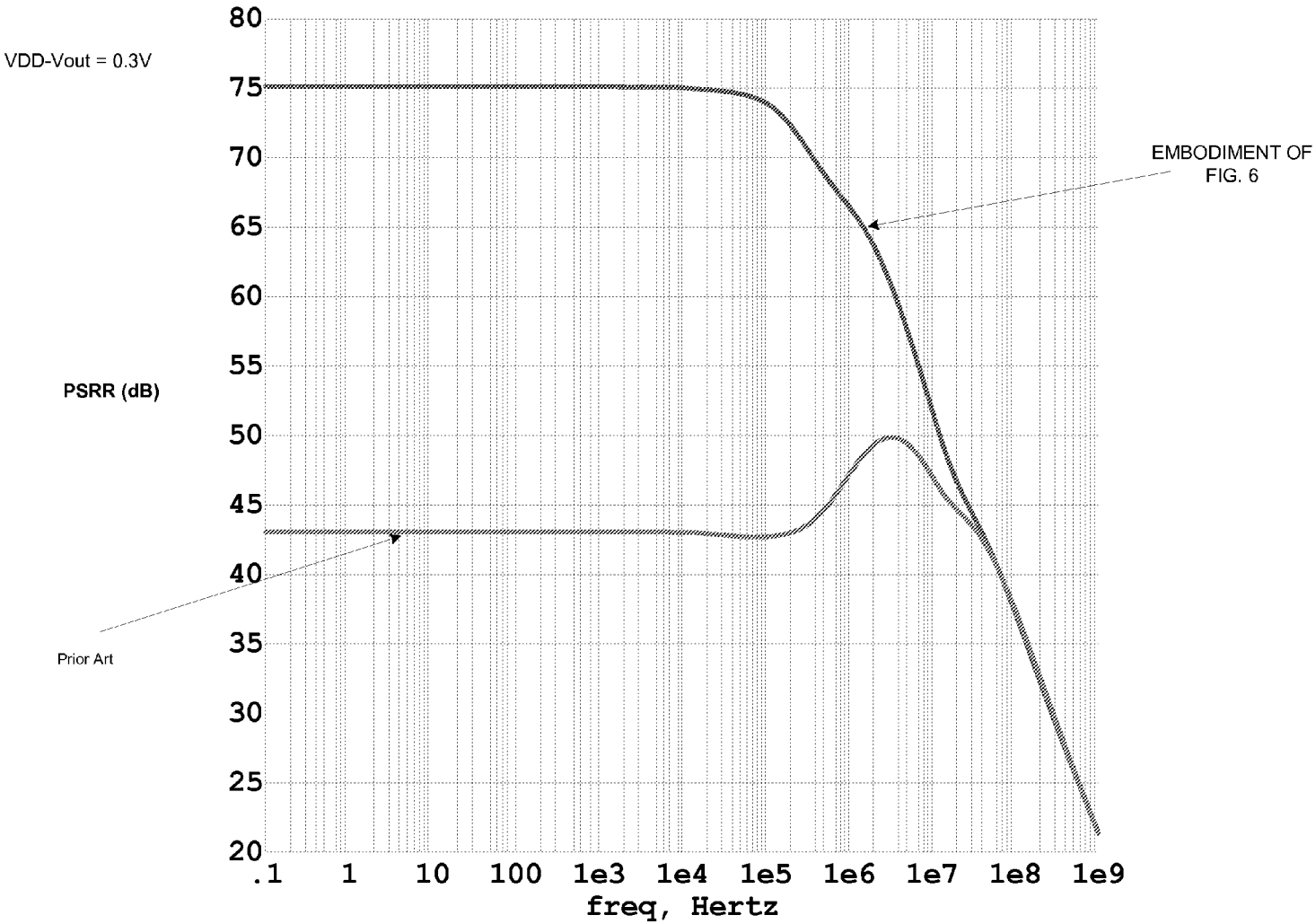
FIG. 7 illustrates a PSRR comparison of the LDO of FIG. 6 vs. the known LDO of FIG. 3 when $V_{DD}-V_{OUT}=0.3V$.
Figure 8:
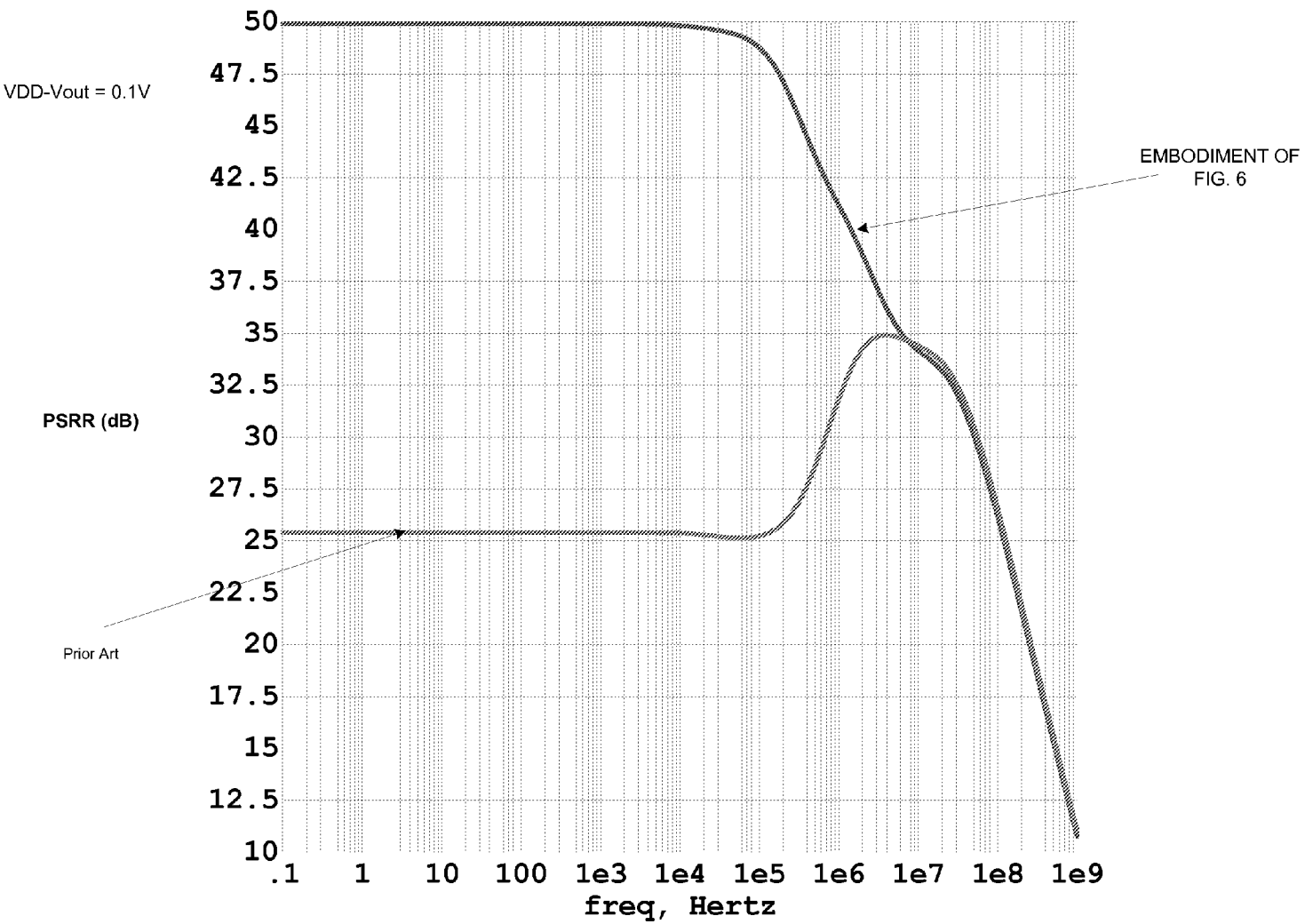
FIG. 8 illustrates a PSRR comparison of the LDO of FIG. 6 vs. the known LDO of FIG. 3 when $V_{DD}-V_{OUT}=0.1V$.

FIGS. 7 and 8 illustrate PSRR comparisons of the LDO of FIG. 6 vs. the known LDO of FIG. 3 when $V_{DD}-V_{OUT}=0.3$V and $V_{DD}-V_{OUT}=0.1$V, respectively. As shown in FIGS. 7 and 8, LDOs of the present invention may have substantially improved PSRR over the prior art.

Those skilled in the art may appreciate from the foregoing description that the present invention may be implemented in a variety of forms, and that the various embodiments may be implemented alone or in combination. For example, the transistors used in the LDOs are not limited to MOS transistors. The principles of the present invention may work equally well by replacing MOS transistors with other types of transistors such as bipolar transistors or in other types of LDOs. Therefore, while the embodiments of the present invention have been described in connection with particular examples thereof, the true scope of the embodiments and/or methods of the present invention should not be so limited since other modifications will become apparent to the skilled practitioner upon a study of the drawings, specification, and following claims.

What is claimed is:

1. A low dropout voltage regulator (LDO), comprising:

a first amplifier including a first input for receiving a reference voltage and a second input for receiving a voltage proportional to an output of the LDO;

a current mirror that mirrors an input current at a first end of the current mirror to an output current at a second end of the current mirror, the input current of the current mirror being controlled by an output of the first amplifier and the output current of the current mirror being supplied to the output of the LDO;

an amplifying element coupled to the current mirror; and a current source coupled to the amplifying element and configured to provide a bias current to the amplifying element.

2. The LDO of claim 1, wherein the current mirror includes gate-to-gate connected first and second transistors, and wherein a drain of the first transistor is coupled to the first end of the current mirror and a drain of the second transistor is coupled to the second end of the current mirror.

3. The LDO of claim 2, wherein the amplifying element drives the first transistor to operate in a same operational mode as the second transistor, wherein the operational mode includes one of a saturation mode and a triode mode.

4. The LDO of claim 2, wherein sources of the first and second transistors are coupled to a DC voltage source (VDD).

5. The LDO of claim 1, wherein:

the amplifying element includes a second amplifier including a first input coupled to the first end of the current mirror and a second input coupled to the second end of the current mirror; and the current source is coupled to the second amplifier and configured to provide the bias current to the second amplifier.

6. The LDO of claim 5, further comprising a third transistor, a gate of the third transistor coupled to an output of the second amplifier, a source of the third transistor coupled to the drain of the first transistor, and a drain of the third transistor coupled to a gate of the first transistor.

7. The LDO of claim 6, further comprising a fourth transistor, a gate of the fourth transistor coupled to the output of the first amplifier and a drain of the fourth transistor coupled to a drain of the third transistor.

8. The LDO of claim 7, wherein the current source includes a fifth transistor whose gate is coupled to the gate of the fourth transistor and whose drain is coupled to the second amplifier, the fifth transistor being selected to match the fourth transistor.

9. The LDO of claim 8, wherein the fourth and fifth transistors form the current source.

10. The LDO of claim 7, wherein:

the current source includes a fifth transistor whose gate is coupled to the gate of the fourth transistor and whose drain is coupled to the second amplifier; and the fifth transistor controls a bandwidth of the second amplifier and the fifth transistor is selected to match the fourth transistor.

11. The LDO of claim 5, wherein the first and second amplifiers respectively include one of an operational amplifier and an operational transconductance amplifier (OTA).

12. The LDO of claim 1, wherein:

the amplifying element includes gate-to-gate connected third and fourth transistors;

a source of the third transistor is coupled to the first end of the current mirror and a source of the fourth transistor is coupled to the second end of the current mirror; and an output of the first amplifier controls currents to drains of the third and fourth transistors.

13. The LDO of claim 12, wherein:

the current source includes fifth and sixth transistors;

a gate of each of the fifth and sixth transistors is coupled to the output of the first amplifier; and drains of the fifth and sixth transistors are respectively coupled to the drains of the third and fourth transistors.

14. The LDO of claim 12, wherein at least one of:

the first transistor operates in a same operational mode as the second transistor, wherein the operational mode includes one of a saturation mode and a triode mode;

sources of the first and second transistors are coupled to a DC voltage source ( VDD); and the first amplifier includes one of an operational amplifier and an operational transconductance amplifier (OTA).

15. The LDO of claim 1, further comprising a load device; and wherein the amplifying element includes a multi-stage amplifier having a first stage coupled to the first end of the current mirror and a second stage coupled to the second end of the current mirror.

16. The LDO of claim 15, wherein:

the first stage of the multi-stage amplifier includes a third transistor;

the second stage of the multi-stage amplifier includes gate-to-gate connected fourth and fifth transistors;

the load device is coupled to the drain of the second transistor;

an output of the first amplifier controls currents to a drain of each of the third, fourth, and fifth transistors;

a source of the fourth transistor is coupled to the drain of the first transistor and a source of the fifth transistor is coupled to the drain of the second transistor;

a source of the third transistor is coupled to the drain of the first transistor and a gate of the first transistor is coupled to the drain of the third transistor; and a gate of the third transistor is coupled to the drain of the fifth transistor.

17. The LDO of claim 16, wherein the current source includes sixth, seventh, and eighth transistors whose gates are coupled to the output of the first amplifier and whose drains are respectively coupled to the drains of the fourth, fifth, and third transistors.

18. The LDO of claim 16, wherein at least one of:

the first transistor operates in a same operational mode as the second transistor, wherein the operational mode includes one of a saturation mode and a triode mode;

sources of the first and second transistors are coupled to a DC voltage source (VDD); and the first amplifier includes one of an operational amplifier and an operational transconductance amplifier (OTA).

19. A method of operating a low dropout voltage regulator (LDO), the LDO including an error amplifier, a current mirror, an amplifying element, and a current source, the method comprising:

receiving, by the error amplifier, a reference voltage;

receiving, by the error amplifier, a voltage proportional to an output of the LDO;

generating, by the current source, a bias current based on an output of the error amplifier;

providing the bias current to the amplifying element such that a bandwidth of the amplifying element is regulated;

minimizing, using the amplifying element, a voltage difference between inputs to the amplifying element; and driving, using the amplifying element, a voltage at one end of the current mirror to follow the output of the LDO such that the current mirror is balanced and the LDO maintains a high power supply rejection ratio when dropout voltage is low.

20. A low dropout voltage regulator (LDO), comprising:

means for receiving a reference voltage and a voltage proportional to an output of the LDO;

means for generating a bias current based on an output of the error amplifier;

means for providing the bias current to the amplifying element such that a bandwidth of the amplifying element is regulated;

means for minimizing a voltage difference between inputs to the amplifying element and driving a voltage at one end of the current mirror to follow the output of the LDO such that the current mirror is balanced and the LDO maintains a high power supply rejection ratio when dropout voltage is low.

* * * * *